US010590664B2

(12) United States Patent
Aranburu Etxezarreta et al.

(10) Patent No.: US 10,590,664 B2
(45) Date of Patent: Mar. 17, 2020

(54) CLIMBING SHOE FOR FIXING A CLIMBING SCAFFOLD TO A CONCRETE SECTION OF A BUILDING UNDER CONSTRUCTION

(71) Applicant: ULMA C y E, S. COOP., Oñati (ES)

(72) Inventors: Angel Maria Aranburu Etxezarreta, Oñati (ES); Aritz Zuloaga Agirrebalzategi, Oñati (ES); Ander Egaña Urrutia, Oñati (ES)

(73) Assignee: ULMA C y E, S. Coop., Oñati (ES)

( * ) Notice: Subject to any disclaimer, the term of this patent is extended or adjusted under 35 U.S.C. 154(b) by 0 days.

(21) Appl. No.: 16/178,922

(22) Filed: Nov. 2, 2018

(65) Prior Publication Data

US 2019/0071884 A1 Mar. 7, 2019

Related U.S. Application Data

(63) Continuation of application No. PCT/EP2017/060609, filed on May 4, 2017.

(30) Foreign Application Priority Data

May 4, 2016 (EP) ..... 16382195

(51) Int. Cl.
*E04G 3/28* (2006.01)
*E04G 3/20* (2006.01)
(Continued)

(52) U.S. Cl.
CPC ..... *E04G 11/28* (2013.01); *E04G 3/20* (2013.01); *E04G 3/28* (2013.01); *E04G 5/046* (2013.01); *E04G 2003/286* (2013.01)

(58) Field of Classification Search
CPC ..... E04G 11/28; E04G 5/046; E04G 3/20; E04G 3/28; E04G 2003/286
(Continued)

(56) References Cited

U.S. PATENT DOCUMENTS 4,129,197 A 12/1978 Preston
9,476,210 B2 * 10/2016 Urzelai Ezkibel ..... E04G 11/28
(Continued)

FOREIGN PATENT DOCUMENTS

EP 2365159 * 9/2011 ..... E04G 11/28
KR 20160025467 A 3/2016

OTHER PUBLICATIONS

International Search Report and Written Opinion in corresponding International Application No. PCT/EP2017/060609, dated May 22, 2017.

*Primary Examiner* — Michael Safavi
(74) *Attorney, Agent, or Firm* — Edell, Shapiro & Finnan, LLC

(57) ABSTRACT

A climbing shoe for fixing a climbing scaffold to a concrete section. According to one embodiment the climbing shoe includes a first part including clamps configured for securing a track of the climbing scaffold and allowing the guided movement of the track while the climbing scaffold climbs in a substantially vertical direction. The climbing shoe includes a second part fixed to the concrete section, the first part being coupled to the second part. The first part and the second part are coupled to one another by means of a transverse guide arranged in one of said first and second parts and at least one hook surrounding the transverse guide arranged in the other one of said first and second parts, the hook and the transverse guide being able to slide with respect to one another for laterally disassembling the first part with respect to the second part.

19 Claims, 6 Drawing Sheets

(51) Int. Cl.
*E04G 5/04* (2006.01)
*E04G 11/28* (2006.01)

(58) Field of Classification Search
USPC ..... 425/63, 65; 264/33, 34; 182/82, 87
See application file for complete search history.

(56) References Cited

U.S. PATENT DOCUMENTS 9,945,135 B2 * 4/2018 Aranburu Etxezarreta ..... E04G 5/04
2014/0305070 A1 10/2014 Jin et al.

* cited by examiner

CLIMBING SHOE FOR FIXING A CLIMBING SCAFFOLD TO A CONCRETE SECTION OF A BUILDING UNDER CONSTRUCTION

CROSS-REFERENCE TO RELATED APPLICATIONS

This application relates to and claims the benefit and priority to International Application No. PCT/EP2017/060609, filed May 4, 2017, which claims the benefit and priority to European Application No. EP16382195.2, filed May 4, 2016.

FIELD

The present invention relates to a climbing shoe for fixing a climbing scaffold to a concrete section of a building under construction.

BACKGROUND

Climbing scaffolds suitable for being fixed to a building under construction, particularly to concrete sections of said building, are known in the state of the art, the scaffold comprising substantially vertical tracks arranged parallel to one another, climbing shoes anchored to the corresponding concrete section through respective anchoring means, which are suitable for guiding the respective track in a substantially vertical climbing direction, and a work platform supported by the tracks.

Patent document EP1899548A1 discloses a climbing shoe comprising a first part including clamps suitable for securing and guiding the track, the clamps being coupled to one another in a pivotal manner, such that they can go from a position in which the clamps are closed surrounding the track to a position in which clamps are open allowing the movement of the corresponding track. The climbing shoe further comprises a second part which is fixed to the wall, and a pivoting element configured for retaining the track in a working position and allowing the vertical upward movement of the track guided in the climbing shoe, the first part and the second part being coupled by means of a horizontal bolt parallel to the vertical wall.

EP2365159A1 describes a climbing shoe also comprising a first part including clamps surrounding and guiding the track, and a second part anchored to the corresponding concrete section, the first part being coupled to the second part through a respective bolt. The first part further includes side walls attached to one another by means of horizontal plates, the clamps being articulated to one another and attached to the horizontal plates through a double safety bolt going through said horizontal plates and the clamps. Said double safety bolt keeps the clamps closed for the passage of the track. The first part further comprises a rocker arm configured for retaining the track in the working position blocking its vertical movement and for allowing the track to climb.

SUMMARY OF THE DISCLOSURE

According to one implementation a climbing shoe is provided that comprises a first part including clamps configured for securing a track of the climbing scaffold in a working position and allowing the guided movement of the track while the climbing scaffold climbs in a substantially vertical direction, and a second part fixed to the concrete section, the first part being coupled to the second part in the working position.

The first part and the second part are coupled to one another by means of a transverse guide arranged in one of said parts and at least one hook surrounding the transverse guide arranged in the other one of said parts, the hook and the transverse guide being able to slide with respect to one another for laterally disassembling the first part with respect to the second part.

An optimized climbing shoe that can be easily disassembled laterally, particularly the first part including the clamps with respect to the second part fixed to the concrete section, is thereby obtained.

These and other advantages and features will become evident in view of the drawings and the detailed description.

DETAILED DESCRIPTION

Figure 1:
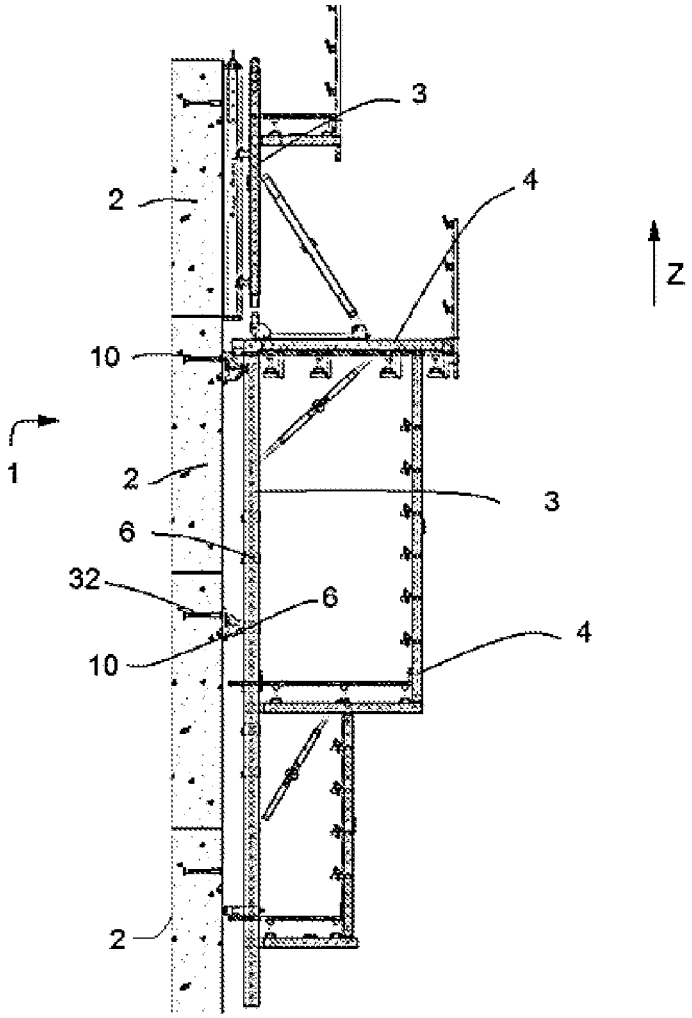
FIG. 1 shows a side view of a climbing scaffold fixed to a building under construction comprising climbing shoes according to one embodiment.
Figure 2:
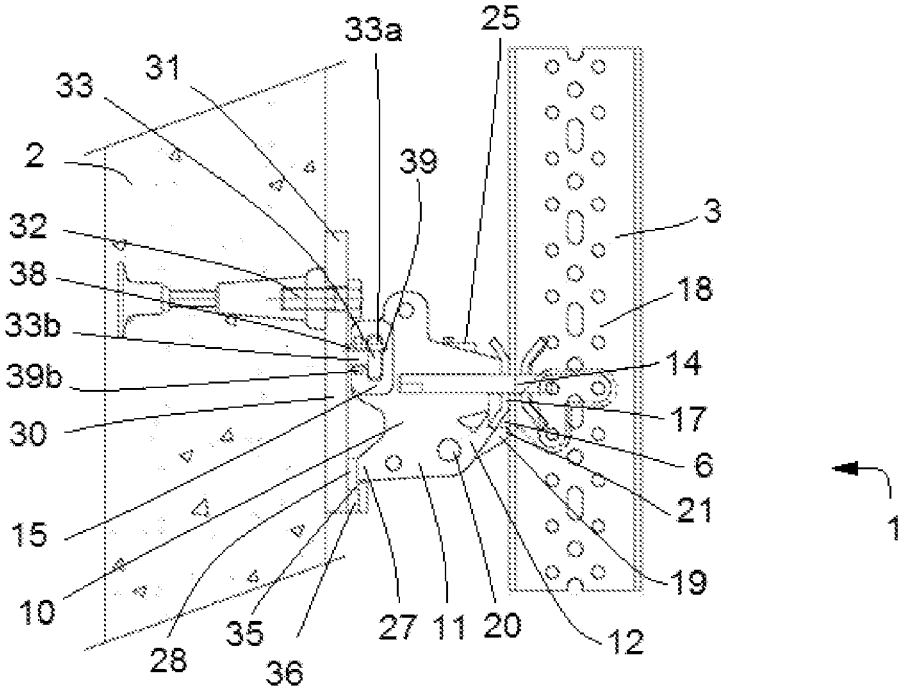
FIG. 2 shows a detailed view of the climbing scaffold fixed to the building under construction shown in FIG. 1 in which one of the climbing shoes is shown fixed to the building and coupled to a track of the climbing scaffold.

FIG. 1 shows a climbing scaffold 1 fixed to a building under construction, particularly to concrete sections 2 of said building, comprising tracks 3, climbing shoes 10 which are anchored to the corresponding concrete section 2 through respective anchoring means 32 and suitable for guiding the respective track 3 in a substantially vertical climbing direction Z, and a work platform 4 supported by the tracks 3. In the embodiment shown in the drawings, the climbing scaffold 1 comprises two tracks 3 arranged substantially parallel to one another, each of which is simultaneously supported and guided by at least two climbing shoes 10 arranged substantially aligned to one another.

Each track 3 is formed by at least one profile having a substantially H-shaped cross-section and further comprises fastening elements 6 housed partially inside the corresponding H-shaped profile, extending towards the anchoring means 32 of the respective climbing shoes 10. The fastening elements 6 cooperate with the corresponding climbing shoes 10 in the fastening of the corresponding track 3 and in the climbing of the climbing scaffold 1.

Each climbing shoe 10 comprises a first part 11 including clamps 14 configured for securing the corresponding track 3, which in a working position shown in FIGS. 1, 2, 3, 5 and 6, allow the guided movement of the track 3 while the climbing scaffold 1 climbs in the climbing direction Z, and a second part 30 fixed to the concrete section 2, the first part 11 being coupled to the second part 30 in the working position. The first part 11 and the second part 30 are coupled to one another by means of a transverse guide 33 arranged in one of said parts 11 and 30 and at least one hook 15 surrounding the transverse guide 33 arranged in the other one of said parts 11 and 30, the hook 15 and the transverse guide 33 being able to slide with respect to one another for laterally disassembling the first part 11 with respect to the second part 30.

In the embodiment shown in the drawings, the second part 30 comprises the transverse guide 33 whereas the first part 11 comprises two hooks 15 surrounding said transverse guide 33. Furthermore, the transverse guide 33 comprises a profile having a substantially T-shaped cross-section which is surrounded by the hooks 15, each hook 15 including a geometry complementary to the profile of the transverse guide 33.

The second part 30 comprises a plate 31 which is anchored to the concrete section 2 through an anchoring bolt 32. Furthermore, the second part 30 comprises a support 35 on which a lower end 27 of the first part 11 is supported, said second part 30 supporting the first part 11 through said support 35. Therefore, most of the stresses to which the climbing shoe 10 is subjected are supported by the anchoring bolt 32 and by the support 35, the stresses supported by the transverse guide 33 being minimized. Particularly, as a result of the support 35 the transverse guide 33 only supports horizontal loads, bending in said transverse guide 33 being prevented. The support 35 extends in the transverse direction into one end of the plate 31 and includes a housing 36 in the transverse direction, in which a projection 28 of the first part 11 is partially housed, as shown in FIGS. 2, 7, 8 and 9. The projection 28 is coupled to the support 35 in a movable manner along the housing 36.

In the embodiment shown in the drawings, the second part 30 comprises two supports 35 arranged aligned with one another, each of which has a substantially U-shaped cross-section. The projection 28 of the first part 11 in turn has a substantially rectangular cross-section which is partially housed inside the supports 35 of the second part 30.

Furthermore, the second part 30 is anchored to a vertical surface of the concrete section 2. In other embodiments not shown in the drawings, the second part 30 can be configured for being anchored to a slab of the concrete section 2 or to other parts of said concrete section 2.

Figure 3:
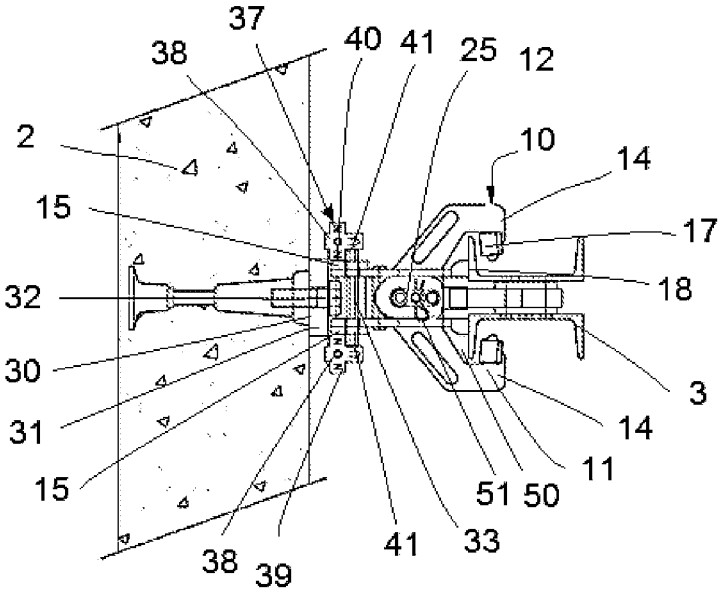
FIG. 3 shows a top view of the climbing shoe shown in FIG. 2 fixed to the building under construction and coupled to the track of the climbing scaffold.
Figure 5:
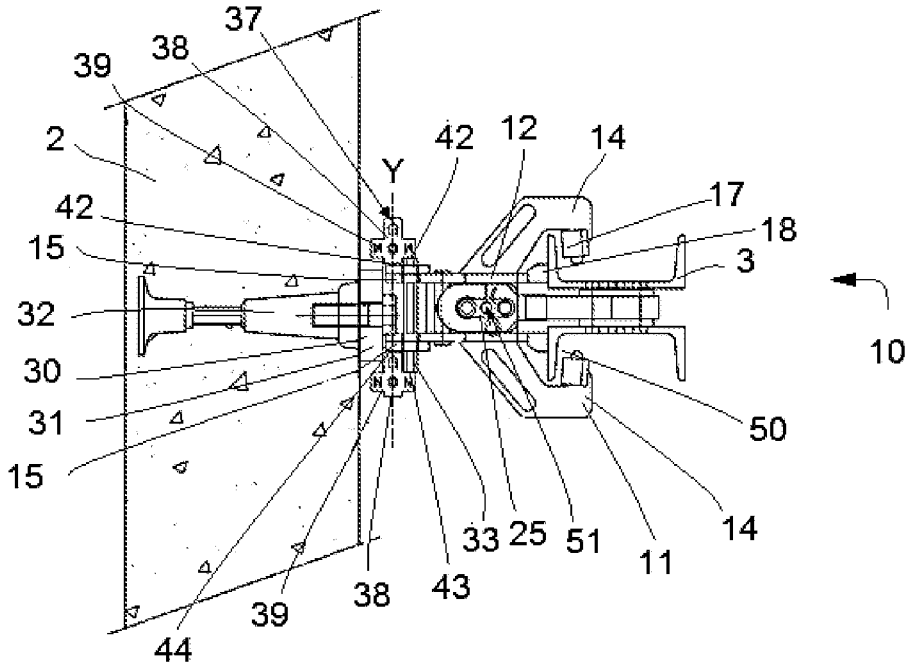
FIG. 5 shows a top view of the climbing shoe shown in FIG. 2 fixed to the building under construction and coupled to the track of the climbing scaffold 1, in an extreme blocking position.
Figure 6:
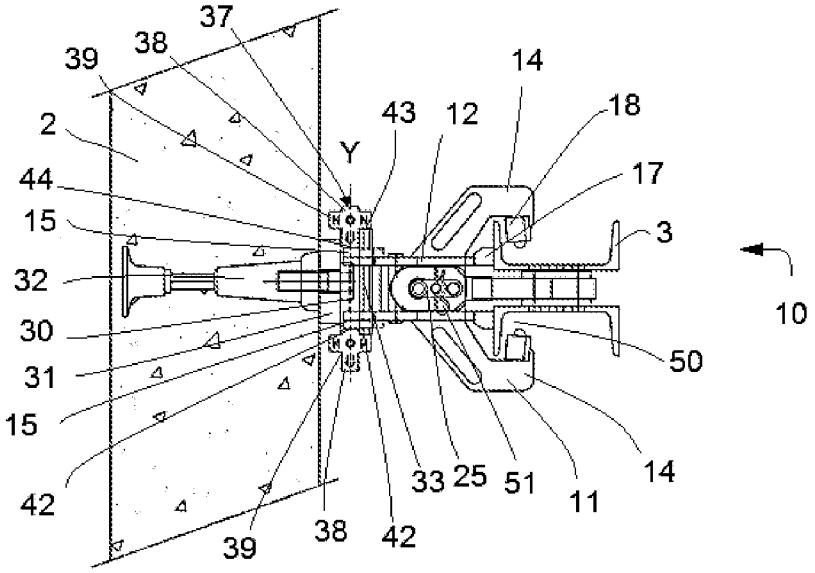
FIG. 6 shows a top view of the climbing shoe shown in FIG. 2 fixed to the building under construction and coupled to the track of the climbing scaffold, in another extreme blocking position.
Figure 7:
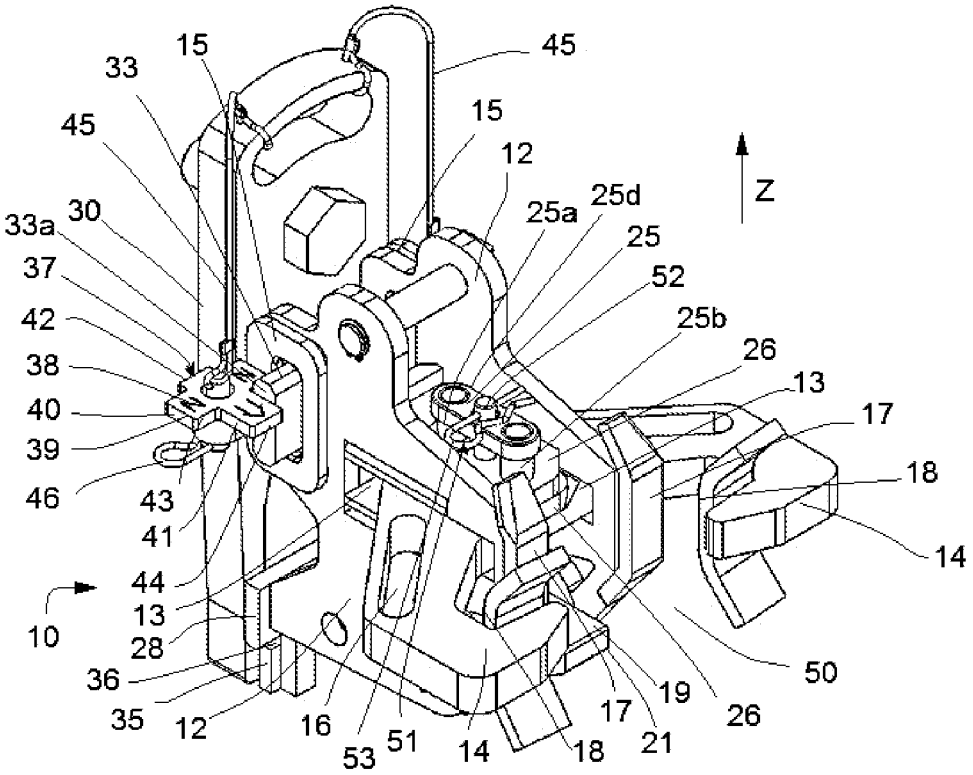
FIG. 7 shows a perspective view of the climbing shoe shown in FIG. 2.
Figure 8:
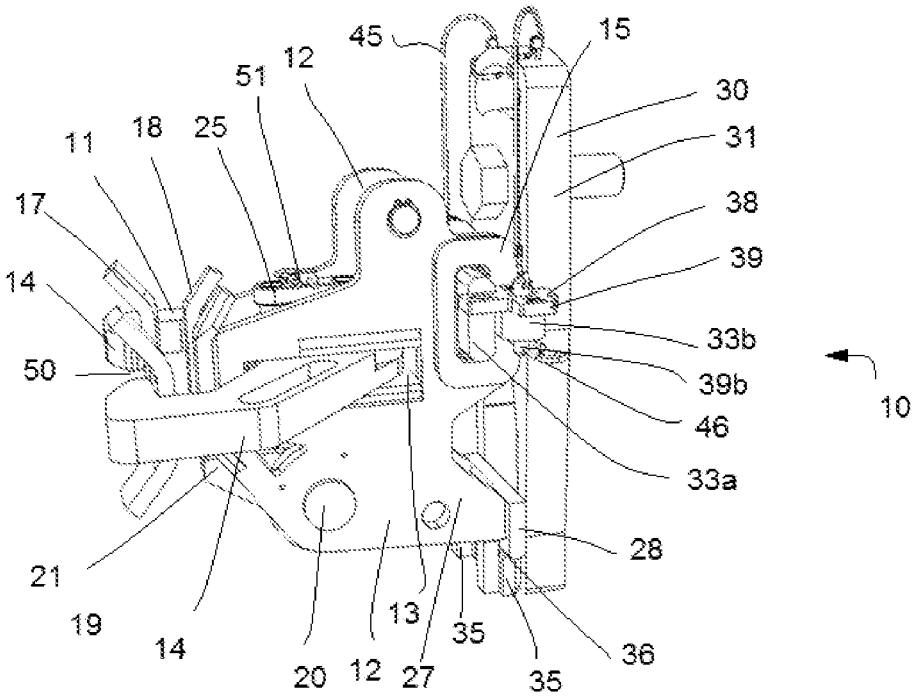
FIG. 8 shows another perspective view of the climbing shoe shown in FIG. 2.
Figure 9:
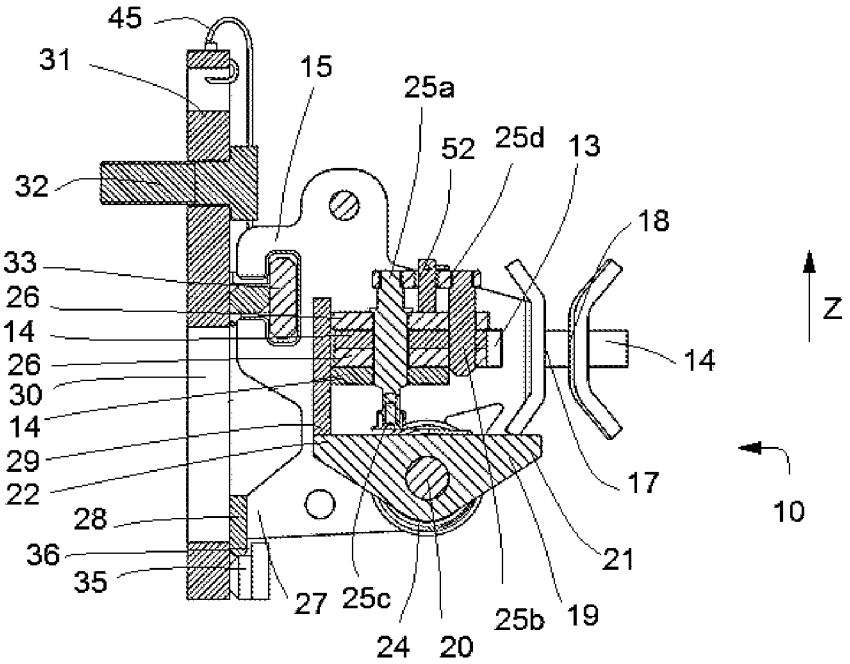
FIG. 9 shows a sectioned view of the climbing shoe shown in FIG. 2.

On the other hand, the first part 11 of the climbing shoe 10, shown in detail in FIGS. 7 to 9, comprises in addition to the two clamps 14, side walls 12 arranged substantially parallel to one another, and attachment plates 26 of said side walls 12, arranged substantially orthogonal to the side walls 12, the two clamps 14 being coupled to one another and to the attachment plates 26 in a pivotal manner through a double safety bolt 25. Each clamp 14 goes through the corresponding side wall 12 through a groove 13 in the corresponding side wall 12. When the climbing shoe 10 is in the working position, the clamps 14 are closed, as shown in FIGS. 3, 5 and 6, demarcating a housing 50 through which the respective track 3 moves in the climbing direction Z. In said position, the clamps 14 surround the track 3, particularly a flange of the track 3, guiding the movement of the track 3. To that end, both the clamps 14 and the side walls 12 comprise guides 17 and 18 in the climbing direction Z collaborating in the guiding of the track 3. Said guides 17 and 18 together with the clamps 14 demarcate the housing 50.

In the working position, the double safety bolt 25 goes through the clamps 14 and the attachment plates 26, keeping the clamps 14 closed. The double safety bolt 25 comprises two arms **25*a* and 25*b* of different length such that, when operators want to open the clamps 14, they have to pull the double safety bolt 25 vertically upwards until one of the arms 25*b* is released from the clamps 14 and from the respective attachment plates 26, and then pull on the grips 16 arranged in each clamp 14, causing them to pivot with respect to the other arm 25*a* of the double safety bolt 25 for opening same. The longer arm 25*a* includes at its free end a Seeger ring 25*c* to prevent it from being disassembled. Furthermore, to prevent pulling the double safety bolt 25 by accident, the climbing shoe 10 includes safety means 51 including a rod 52 projecting from one of the attachment plates 26 going through the double safety bolt 25, particularly a plate 25*d* attaching the arms 25*a* and 25*b* of said safety bolt 25 and a catch 53 which transversely goes through the rod 52 and abuts against the plate 25*d* of the double safety bolt 25, such that for operators to be able to open the clamps 15, they must remove the catch 53 from the rod 52 before pulling on the double safety bolt 25**.

Each climbing shoe 10 further comprises a rocker arm 19, shown in detail in FIG. 9, pivotal with respect to a rotating shaft 20 substantially orthogonal to the pivoting axis of the clamps 14, coupled to the side walls 12 of the first part 11. The rocker arm 19 is suitable for pivoting between the working position, shown in FIG. 2, in which said rocker arm 19 supports the fastening element 6 of the corresponding track 3, and a climbing position in which the rocker arm 19 allows the movement of the track 3 in the climbing direction Z. To that end, the rocker arm 19 comprises a front part 21 which in the working position is partially housed in the housing 50 demarcated by the clamps 14 such that it abuts against the respective fastening element 6 preventing the respective track 3 from moving down, and a rear part 22 which in the working position abuts against a stop 29 coupled to the side walls 12. In the climbing position, as the respective track 3 moves up, the respective fastening elements 6 hit the front part 21 of the respective rocker arms 19, forcing them to rotate to the position in which they allow the upward movement of the track 3. The front part 21 rotates integrally with the rear part 22 of the rocker arm 19 such that when the rocker arm 19 rotates by action of the respective fastening element 6, the rear part 22 is separated from the stop 29 coupled to the side walls 12. Once the fastening element 6 has exceeded the corresponding rocker arm 19, it returns to the working position as a result of a spring 24 coupled to the rotating shaft 20.

Each climbing shoe 10 comprises blocking means 37 fixed to the second part 30 blocking the sliding of the first part 11 with respect to the second part 30. The blocking means 37 comprises blocking elements 38, shown in detail in FIG. 10, each of which has a base 39 which is supported in the transverse guide 33, particularly in a support **33*b* of said transverse guide 33 and a pin or rod 39*b* extending substantially orthogonal to the base 39 and inserted in said transverse guide 33, particularly in the support 33*b* of said transverse guide 33. The blocking element 38 is fixed to the second part 30 through the pin 39***b*, said blocking element 38 being able to rotate with respect to said pin 39*b* when it is inserted in the second part 30. The base 39 abuts against the transverse guide 33 and against the hooks 15, respectively, blocking the movement of the first part 11 with respect to the second part 30 in a neutral blocking position shown in FIG. 3 and in extreme blocking positions shown respectively in FIGS. 5 and 6. Therefore, operators can regulate the position of the first part 11 with respect to the second part 30 for correcting assembly errors, such as for example, the climbing shoes not being arranged in a vertically aligned manner because the concrete sections have recesses, or because the corresponding track had bent due to the loads it supports and it is therefore difficult to introduce the track into the next climbing shoe.

Figure 10:
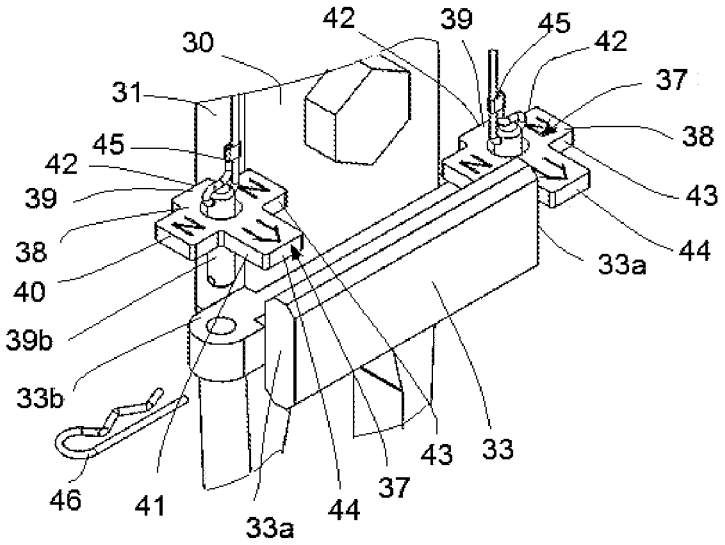
FIG. 10 shows a partial exploded view of the climbing shoe shown in FIG. 2.

In the embodiment shown in the drawings, each climbing shoe 10 comprises two blocking elements 38 each of them arranged on each side of the first part 11 blocking, in a blocking position, the sliding of the first part 11 with respect to the second part 30. Each blocking element 38 is coupled to the second part 30 in a removable manner, there being a need to release the blocking element 38 with respect to the second part 30, either by separating the base 39 from the transverse guide 33 until the blocking element 38 can rotate with respect to the pin 39*b* and be positioned in the new blocking position, or disassembling the blocking element 38 from the second part 30, completely releasing the blocking element 38 from the transverse guide 33, as shown in FIG. 10, to go from one blocking position to another.

The base 39 of the blocking element 38 has a substantially T shape and is demarcated by blocking surfaces 40 and 41 substantially parallel to an axis of symmetry Y of said base 39 and blocking surfaces 42, 43 and 44 substantially orthogonal to the axis of symmetry Y. In the neutral blocking position N shown in FIG. 3, the blocking elements 38 are arranged such that the axis of symmetry Y of the respective base 39 is substantially orthogonal to the transverse guide 33, the stop surfaces 40 and 41 of each blocking element 38 arranged facing the respective hook 15 and the transverse guide 33 abutting against said respective hook 15 and against the transverse guide 33, particularly against one end 33*a* of said transverse guide 33. In the context of the invention, T shape must be understood as both a true T shape and as a cross such as that shown in the drawings, i.e., a T with an upper prolongation.

In the extreme blocking positions, shown respectively in FIGS. 5 and 6, the first part 11 is moved with respect to the second part 30. In the described embodiment, the first part 11 can move about 10 mm from the neutral blocking position N along the transverse guide 33 in both directions to the respective extreme blocking position in which at least one of the stop surfaces 40, 41, 42, 43 and 44 of the respective blocking element 38 abuts against the respective hook 15 and against the transverse guide 33, particularly against the end 33*a* of said transverse guide 33. In the embodiment shown in the drawings, both blocking elements 38 are oriented in the same position. Particularly, in the neutral blocking position, the blocking elements 38 are arranged such that their axis of symmetry is substantially orthogonal to the transverse guide 33, whereas in the extreme positions, both blocking elements 38 are rotated 90° in the same direction from the neutral blocking position N, i.e., the axis of symmetry of the blocking elements 38 is arranged substantially parallel to the transverse guide 33 such that the stop surfaces 42, 43 and 44 facing the respective hook 15 and the transverse guide 33 abut against the hook 15 and against the end 33*a* of the transverse guide 33.

The blocking means 37 further comprises safety means 45 keeping each blocking element 38 permanently coupled to the second part 30 regardless of whether or not said blocking element 38 is inserted in the transverse guide 33. This therefore ensures that the operators do not lose the blocking element 38 and minimizes the risk of the operators forgetting to place the blocking element when changing it from one position to another. The safety means 45 includes a flexible cable, each end of the flexible cable being fixed respectively to the blocking element 38 and to the second part 30, keeping the blocking element 38 permanently coupled to the second part 30. Furthermore, to prevent pulling the blocking element 38 by accident, releasing it, the blocking means 37 comprises a catch 46 transversely going through the rod 39*b* of the corresponding blocking element 38 and abutting against the support 33*b* of the transverse guide 33, such that for operators to be able to release the blocking element 38, they must remove the catch 46 from the rod 39*b* before pulling the blocking element 38.

For the self-climbing scaffold 1 to perform climbing for the purpose of constructing new concrete sections 2, the tracks 3 slide with respect to the climbing shoes 10 having closed clamps 15 in the climbing direction Z and are introduced into the next climbing shoe 10, i.e., introduced into the free climbing shoe 10 arranged immediately above. The self-climbing scaffold 1 comprises means causing the movement of said tracks 3, such as a climbing cylinder and a shoe the details of which have not been described given that they are not the object of the invention and it is not considered necessary to understand same.

For disassembling the corresponding climbing shoe 10, the operators must first take out the safety catch 53 from the double safety bolt 25, then pull the double safety bolt 25 upwards until one of the arms 25*b* of said double safety bolt 25 is released from the clamps 14 and from the attachment plates 16, and open the clamps 14 causing them to pivot with respect to the other arm 25*a* of the double safety bolt 25 by pulling on the grips 16 of the clamps 14. Next, the operators must release one of the blocking elements 38 from the transverse guide 33 such that the first part 11 can slide with respect to the second part 30 anchored in the concrete section 2 and the first part 11 can be separated with respect to the second part 30.

Figure 4:
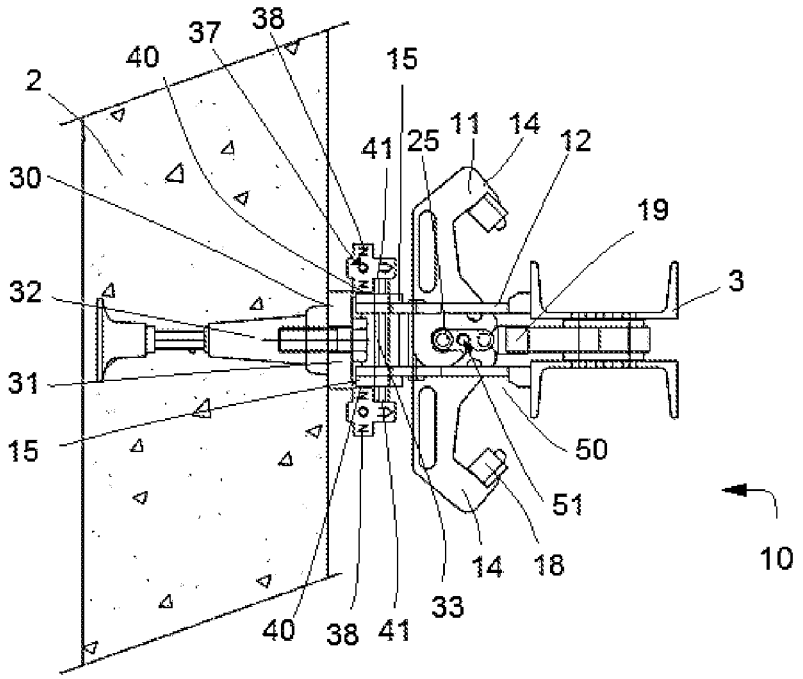
FIG. 4 shows a top view of the climbing shoe shown in FIG. 2 fixed to the building under construction, released from the track of the climbing scaffold.

The climbing shoes 10 are generally fixed to the concrete section 2 corresponding with the blocking means 37 arranged in the neutral position shown in FIGS. 3 and 4. If it is necessary to move the first part 11 with respect to the second part 30 anchored in the corresponding concrete section 2 to enable introducing the corresponding track 3 or making the introduction easier, the operators must release the blocking elements 38 from the transverse guide 33. The operators must therefore separate the base 39 of the respective blocking element 38 from the transverse guide 33 until each blocking element 38 can rotate with respect to its pin 39*b* or disassemble each blocking element 38 from the second part 30 completely releasing the blocking element 38 from the transverse guide 33. The operators shall first remove the catch 46 of the blocking element 38. Next, the operators move the first part 11 with respect to the second part 30 sliding the first part 11 through the hooks 15 along the transverse guide 33 until positioning it in one of the two extreme positions. Once the first part 11 is positioned in one of the extreme blocking positions, the operators block said position by positioning the blocking elements 38 in said extreme blocking positions. In the embodiment shown in the drawings, the operators must rotate the blocking elements 38 ninety degrees with respect to the neutral blocking position, placing both blocking elements 38 in the same orientation such that they abut respectively against the hooks 15 and against the transverse guide 33 preventing the relative movement between the first part 11 and the second part 30.

In other embodiments not depicted in the drawings, the hooks can be comprised in the second part of the climbing shoe whereas the transverse guide can be included in the first part.

What is claimed is:

1. A climbing shoe for fixing a climbing scaffold that includes a track to a concrete section of a building, the climbing shoe comprising:

a first part having a first side and a second side, the first and second sides respectively including first and second clamps that are moveable with respect to one another between a closed position and an open position, in the closed position the first and second clamps at least partially form a housing through which a part of the track is configured to be guided in a vertical direction;

a second part configured to be fixed to the concrete section, the first part and the second part configured to be coupled to one another by a transverse guide arranged in one of the first and second parts and at least one hook that partially surrounds the transverse guide arranged in the other one of the first and second parts in which the transverse guide is arranged, a disassembly of the first part from the second part only being permitted by at least one of the hook and transverse guide being able to slide sideways with respect to the other, the transverse guide and hook each having a first side corresponding to the first side of the first part and a second side corresponding to the second side of the first part; and first and second blocking elements together being capable of causing the first and second parts to assume a neutral position and first and second extreme positions, when in the neutral position the first part is centered with the second part, when in the first extreme position the first part is positioned to a right of the neutral position, when in the second extreme position the first part is positioned to a left of the neutral position.

2. The climbing shoe according to claim 1, wherein the first blocking element includes a first base and the second blocking element includes a second base, each of the first and second bases including a first projection of a first length and a second projection of a second length that is shorter than the first length, each of the first and second projections respectively having at an end thereof first and second blocking surfaces.

3. The climbing shoe according to claim 2, wherein the first and second projections are arranged perpendicular to one another.

4. The climbing shoe according to claim 2, wherein the at least one hook includes spaced-apart first and second hooks, when the first and second parts are in the neutral position the second blocking surface of the first base abuts an outward facing side of the first hook and the second blocking surface of the second base abuts the an outward facing side of the second hook.

5. The climbing shoe according to claim 3, wherein the at least one hook includes spaced-apart first and second hooks, when the first and second parts are in the neutral position the second blocking surface of the first base abuts an outward facing side of the first hook and the second blocking surface of the second base abuts the an outward facing side of the second hook.

6. The climbing shoe according to claim 2, wherein the at least one hook includes spaced-apart first and second hooks, when the first and second parts are in the first extreme position the first blocking surface of the first base abuts an outward facing side of the first hook, and when the first and second parts are in the second extreme position the first blocking surface of the second base abuts an outward facing side of the second hook.

7. The climbing shoe according to claim 3, wherein the at least one hook includes spaced-apart first and second hooks, when the first and second parts are in the first extreme position the first blocking surface of the first base abuts an outward facing side of the first hook, and when the first and second parts are in the second extreme position the first blocking surface of the second base abuts an outward facing side of the second hook.

8. The climbing shoe according to claim 4, wherein when the first and second parts are in the first extreme position the first blocking surface of the first base abuts the outward facing side of the first hook, and when the first and second parts are in the second extreme position the first blocking surface of the second base abuts the outward facing side of the second hook.

9. The climbing shoe according to claim 5, wherein when the first and second parts are in the first extreme position the first blocking surface of the first base abuts the outward facing side of the first hook, and when the first and second parts are in the second extreme position the first blocking surface of the second base abuts the outward facing side of the second hook.

10. The climbing shoe according to claim 1, wherein the second part includes a support on which a lower end of the first part is supported.

11. The climbing shoe according to claim 10, wherein the support extends in a direction orthogonal to the vertical direction and includes a housing in which a projection arranged in the lower end of the first part is at least partially housed, the projection being movable along the housing for laterally disassembling the first part with respect to the second part.

12. The climbing shoe according to claim 1, wherein the second part comprises the transverse guide and the first part comprises the at least one hook surrounding the transverse guide.

13. The climbing shoe according to claim 12, wherein the first part comprises two hooks that partially surround the transverse guide.

14. The climbing shoe according to claim 1, wherein the transverse guide comprises a profile having a substantially T-shaped cross-section.

15. The climbing shoe according to claim 1, wherein the first and second blocking elements are coupled to the second part, the first and second blocking elements being respectively positioned on the first and second sides of the first part to block a sliding of the first part with respect to the second part.

16. The climbing shoe according to claim 15, wherein each of the first and second blocking elements includes a base demarcated by first and second blocking surfaces, the first blocking surface abutting the transverse guide and the second blocking surface abutting the at least one hook to limit movement between the first part and the second part.

17. The climbing shoe according to claim 16, wherein the base of each of the first and second blocking assemblies has is T-shaped.

18. The climbing shoe according to claim 2, further comprising first and second rods that respectively pass through the base of each of the first and second blocking elements, the first and second blocking elements being moveable between the neutral and first and second extreme blocking positions by a rotation of their respective base with respect to the first rod and second rod.

19. The climbing shoe according to claims 1, wherein each of the first and second blocking elements are tethered to the second part.

* * * * *